US006079457A

United States Patent [19]

Crittenden

[11] Patent Number: 6,079,457

[45] Date of Patent: Jun. 27, 2000

[54] SEALLESS STRAPPING TOOL AND METHOD THEREFOR

[75] Inventor: David E. Crittenden, Schaumburg, Ill.

[73] Assignee: Illinois Tool Works Inc., Glenview, Ill.

[21] Appl. No.: 09/289,221

[22] Filed: Apr. 9, 1999

[51] Int. Cl.[7] ..... B21F 9/02

[52] U.S. Cl. ..... 140/93.2; 140/152

[58] Field of Search ..... 140/93.2, 93.4, 140/150, 152, 123.5, 123.6

[56] References Cited

U.S. PATENT DOCUMENTS

| | | | |
|---|---|---|---|
| 2,072,566 | 3/1937 | Perrelet | 140/123.6 |
| 2,210,510 | 8/1940 | Sutton | 140/93.2 |
| 2,549,626 | 4/1951 | Mosey | 140/93.2 |

OTHER PUBLICATIONS

Orgapak Ltd., Steel Strapping Tool Brochure, 2–91, 3 pages.

*Primary Examiner*—Lowell A. Larson
*Attorney, Agent, or Firm*—Donald J. Breh; Mark W. Croll; John P. O'Brien

[57] ABSTRACT

A sealless strapping tools and methods therefor including a feed wheel for engaging and tensioning an upper strap portion, a strap sealing actuator cam engageable with a strap sealing member to engage the strap sealing member with overlapping strap portions, a lifting cam engageable with a strap sealing member to disengage the strap sealing member from the overlapping strap portions, a release cam engageable with a pivotal link to disengage the feed wheel from the strap before the lifting cam fully disengages the strap sealing member from the overlapping strap portions.

20 Claims, 2 Drawing Sheets

SEALLESS STRAPPING TOOL AND METHOD THEREFOR

BACKGROUND OF THE INVENTION

To present invention relates generally to sealless steel strapping tools, and more particularly to combination strap tensioning and sealing tools.

Sealless strapping tools are known generally and used widely to seal overlapping strap portions tensioned about a load without the use of a separate sealing member that is clamped about the overlapping strap portions. In sealless metal strapping tools, it is known generally to seal the overlapping strap portions with a punch and die assembly.

The SPC-3431 sealless steel strapping tool made by ITW Signode, for example, comprises a feed wheel disposed on a trailing end of a base plate that tensions an upper strap portion by drawing the strap portion over an underlying strap portion disposed and retained on the base plate. After tensioning, a plurality of dies are moved sequentially toward and into engagement with overlapping strap portions supported on a punch on the base plate to interlockingly fasten the overlapping strap portions. During the sealing operation, the feed wheel maintains tension on the overlapping strap portions engaged by the punch and die assembly to set the joint formed thereby. After sealing, the tensioned upper strap portion is severed by a strap cutter disposed between the punch and feed wheel. The dies and cutter are actuated by corresponding cams disposed on a rotating shaft, thereby controlling the timing of the sealing and cutting operations. The SPC-3431 tool is designed for tensioning and sealing ¾ inch width strap, which is a relatively light gauge strap that is severed easily. The strap cutter of the SPC-3431 tool severs the strap while it is under tension by merely scoring it, rather than cutting fully therethrough. The strap cutter in the SPC 3431 tool however is not effective at severing heavier gauge strap, for example strap widths greater than 1 inch or so.

The CH-4632 sealless steel strapping tool made by ITW Orgapack comprises a feed wheel disposed on a leading end of a base plate that tensions an upper strap portion by pushing the strap portion over an underlying strap portion disposed and retained on the base plate. After tensioning, a plurality of jaw-like dies are actuated in cooperation with a punch to fasten the overlapping strap portions. The upper strap portion in the CH-4632 tool, however, is not maintained under tension during the sealing operation by virtue of the location of the feed wheel on the leading end of the base plate. The feed wheel in the CH-4632 tool is disengaged manually from the strap after sealing the overlapping strap portions, and more particularly after the jaws are released therefrom. The CH-4632 also comprises an angled strap cutter located on the trailing end of the base plate. The angled strap cutter is capable of cutting relatively heavy gauge strap, for example strap widths greater than 1 inch, and is operable when the strap is not under tension.

The present invention is drawn toward advancements in the art of sealless strapping tools for tensioning and sealing overlapping strap portions.

An object of the invention is to provide novel sealless strapping tools and methods therefor that overcome problems in the art.

Another object of the invention is to provide novel sealless strapping tools and methods therefor that are economical.

A further object of the invention is to provide novel sealless strapping tools and methods therefor for tensioning and sealing strap, especially heavier gauge steel strap.

Another object of the invention is to provide novel sealless strapping tools and methods therefor that form robust sealless joints having relatively low profiles with minimal strap deformation.

A more particular object of the invention is to provide novel sealless strapping tools and methods therefor comprising generally a feed wheel for engaging and tensioning overlapping strap portions, a strap sealing member engageable with overlapping strap portions to form a joint therebetween, a lifting cam engageable with the strap sealing member to disengage the strap sealing member from the overlapping strap portions, a release cam engageable with a pivotal link to disengage the feed wheel from the strap portion before the lifting cam fully disengages the strap sealing member therefrom.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
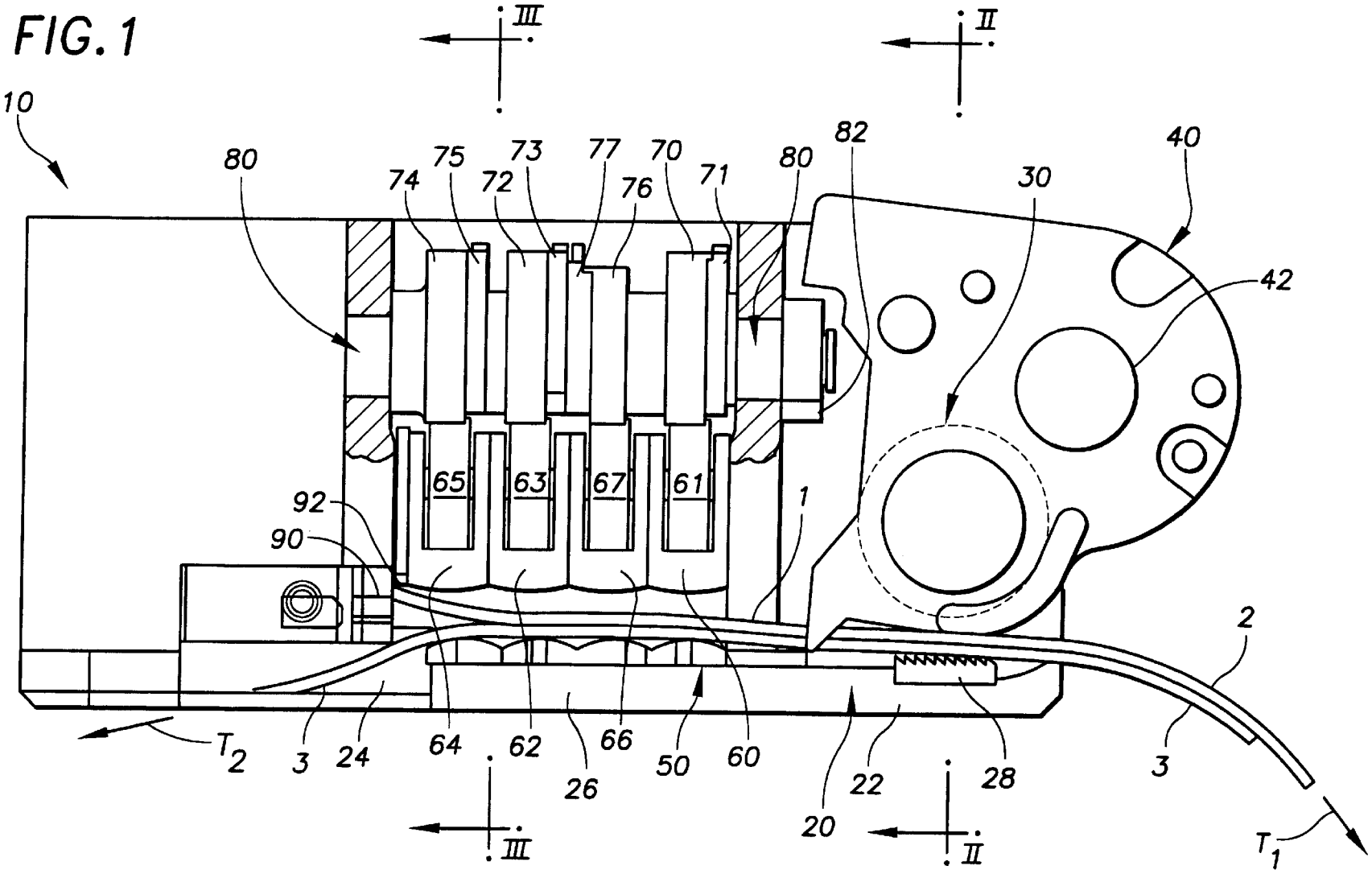
FIG. 1 is a partial side view of a sealless strapping tool according to an exemplary embodiment of the present t invention.

In FIG. 1, the exemplary sealless strapping tool 10 comprises generally a base plate 20, a feed wheel 30 located adjacent a leading end 22 portion of the base plate 20, a strap cutter located along on a trailing end portion 24 of the base plate, and strap sealing member located along an intermediate portion 26 of the base plate 20, generally between the feed wheel and the strap cutter.

The feed wheel 30 is frictionally engageable with overlapping strap portions 2 and 3 disposed on the base plate 20 to tension an interconnecting strap portion formed in a loop about a load, not shown in the drawing but known generally. The feed wheel 30 is engageable, more particularly, with the upper strap portion 2 while the lower strap portion 3 is engaged by and retained on the base plate 20, whereby the lower strap portion 3 remains stationary relative to the upper strap portion 2 during tensioning thereof. In the exemplary embodiment, a clutch plug 28 disposed on the base plate 20 opposite the feed wheel 30 is frictionally engageable with the lower strap portion 3 during tensioning to retain the lower strap portion 3 on the base plate 20 as the upper strap portion 2 is tensioned relative thereto.

The feed wheel 30 is rotatably coupled to a pivotal link 40 that pivots about a pivot member 42 to move the feed wheel 30 toward and away from the base plate 20 to engage and disengage the upper strap portion 2, as discussed more fully below. The feed wheel 30 and the pivotal link 40 are located on the leading end portion 22 of the base plate 30, and the feed wheel 30 rotates in a direction, clockwise in FIG. 1, that pushes the upper strap portion 2 across the base plate 20 generally toward the trailing end portion 24 thereof, and more particularly toward the strap sealing member and strap cutter, as discussed further below.

After tensioning, generally, the strap sealing member is moved toward the base plate and into engagement with the overlapping strap portions disposed thereon to join interlockingly, or seal, the overlapping strap portions. After the strap sealing member is engaged with the overlapping strap portions, the feed wheel is moved away from the base plate to disengage the feed wheel from the upper strap portion while the strap sealing member remains at least partially engaged with the overlapping strap portions. After the feed wheel is disengaged from the upper strap portion, the strap sealing member is moved away from the base plate and disengaged from the overlapping strap portions.

Disengaging the feed wheel from the upper strap portion before the strap sealing member is disengaged therefrom applies opposing tensile forces to the upper and lower strap portions engaged by the strap sealing member. The opposing tensile forces are necessary to set the joint formed by the sealing member. The strapping tool of the present invention thus forms a robust, relatively low profile strap joint having minimal strap deformation, which is highly desirable. In the absence of the opposing tensile forces, the overlapping strap portions would separate when the strap sealing member is disengaged therefrom, unless the overlapping strap portions are deformed substantially. Substantial strap deformation however is undesirable since it produces generally an undesirable joint profile and increases wear on the tool. After disengaging the feed wheel, the overlapping strap portions are further joined preferably by a reversed strap sealing member, as discussed more fully below.

In FIG. 1, upon tensioning the upper strap portion 2 by rotating the feed wheel, the upper strap portion has a tensile force applied thereto in the direction of arrow T1 and the lower strap portion 3 has a tensile force applied thereto in the direction of arrow T2. After disengaging the feed wheel from the upper strap portion 2, the end portion 1 thereof engaged by the strap sealing member also has a tensile force applied thereto in the direction of arrow T1. The tensile force in the direction of arrow T1, however, does not act on the end portion 1 of the upper strap portion 2 until the upper strap portion 2 is released by the feed wheel. In other words, there is no tension on the end portion 1 of the upper strap portion 2 engaged by the strap sealing member until the feed wheel is disengaged from the upper strap portion. Upon disengaging the feed wheel from the upper strap portion, to apply opposing tensile forces to the overlapping strap portions 2 and 3, the strap sealing member may be disengaged therefrom without separation of the upper and lower strap portions forming the joint.

Generally, the strap sealing member is moved toward the base plate and into engagement with the overlapping strap portions by a strap sealing actuator cam, and the strap sealing member is moved away from the base plate and disengaged from the overlapping strap portions by a lifting cam. The feed wheel is disengaged from the upper strap portion by a release cam that pivots the pivotal link to move the feed wheel away from the base plate. The strap sealing cam, release cam and lifting cam are disposed and phase oriented on a rotatable shaft to move the strap sealing member toward the base plate, and to move feed wheel away from the base plate before moving the strap sealing member away therefrom.

In the exemplary embodiment of FIG. 1, the strap sealing member comprises first, second, third and fourth dies 60, 62, 64 and 66 actuatably disposed opposite a punch 50 on the base plate 20. Corresponding first, second, third and fourth die actuator cams 70, 72, 74 and 76 are engageable with a corresponding one of the first, second, third and fourth dies 60, 62, 64 and 66 to move the dies toward the punch 50 and into engagement with overlapping strap portions disposed thereon. In other embodiments, the strap sealing member may include fewer or additional dies and corresponding die actuator cams.

Figure 3:
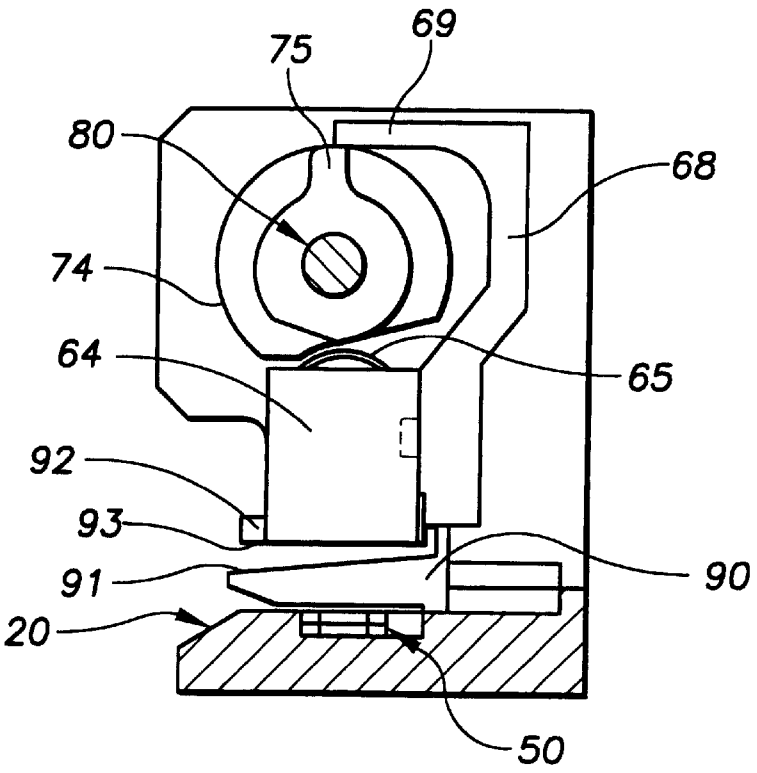
FIG. 3 is a partial sectional view along lines III—III of FIG. 1.

The die actuator cams are preferably engageable with corresponding first, second, third and fourth rollers 61, 63, 65 and 67 associated with each of the dies, as is known generally. FIG. 3 illustrates more particularly the third die cam actuator 74 engageable with the third roller 65 to move the third die 64 toward the base plate 20, and more particularly toward the punch 50 on which the overlapping strap portions 2 and 3 are disposed, upon rotation of the rotatable shaft 80. The dies are retained and move along guides formed in the housing, and cooperate with corresponding structure on the punch 50 to interlockingly join the overlapping strap portions 2 and 3, as is known generally.

In the exemplary embodiment, the first, second and third die actuator cams 70, 72 and 74 are disposed and phase oriented on a rotatable shaft 80 to sequentially move the first, second and third dies 60, 62 and 64 toward the base plate and into engagement with the overlapping strap portions 2 and 3. In one embodiment, the die actuator cams 70, 72 and 74 are phase oriented to first move the third die 64 into engagement with the overlapping strap portions 2 and 3, followed by the second die 62 and then the first die 60.

In the exemplary embodiment, the first, second, third and fourth dies each have corresponding first, second, third and fourth lifting members with corresponding arm portions associated therewith. FIG. 3 illustrates the third die 64 and its corresponding third lifting member 68 and arm portion 69. The lifting members of the other dies are configured similarly. In FIG. 1, the lifting cam comprises first, second, third and fourth die lifting cams 71, 73, 75 and 77 engageable with a corresponding one of the first, second, third and fourth lifting members, and more particularly the corresponding arm portions thereof, to move the second, third and fourth dies away from the punch 50. FIG. 3 illustrates the third lifting cam 75 engageable with the arm 69 of the third lifting member 68 to move the third die 64 away from the base plate 20 to disengage the third die from overlapping strap portions 2 and 3 on the punch 50 after the feed wheel 30 is disengaged from the upper strap portion 2. The first, second and fourth lifting cams are configured similarly, although they do not necessarily have the same phase orientation on the rotatable shaft 80, as discussed further below.

In the exemplary embodiment, the first, second and third lifting cams 71, 73 and 75 are phase oriented on the rotatable shaft 80 to move the corresponding first, second and third dies away from the base plate 20 generally simultaneously to disengage the overlapping strap portions 2 and 3 disposed on the punch 50 after the feed wheel 30 is disengaged from the upper strap portion 2. The first, second and third lifting cams 71, 73 and 75 are preferably phased oriented on the shaft 80 to partially disengage the corresponding first, second and third dies 60, 62 and 64 from the overlapping strap portions 2 and 3 before the feed wheel 30 is disengaged from the upper strap portion 2. In this preferred mode of operation, the first, second and third dies 60, 62 and 64 are at least partially engaged with the overlapping strap portions 2 and 3 when the feed wheel 30 is disengaged from the upper strap 2.

Figure 2:
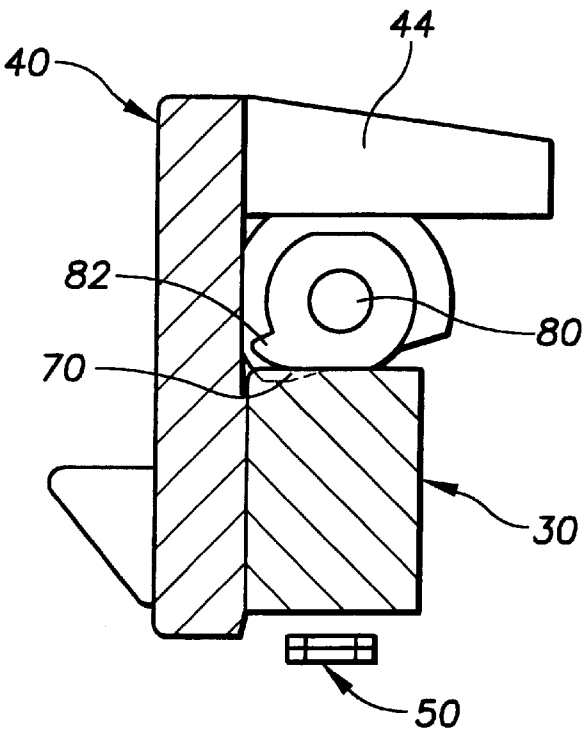
FIG. 2 is a partial sectional view taken along lines II—II of FIG. 1.

In the exemplary embodiments of FIGS. 1 and 2, an exemplary release cam 82 is disposed on the rotatable shaft 80 where it is engageable with the pivotal link 40 to pivot the link 40 about the pivot axis 42 in a direction, clockwise in FIG. 1, to move the feed wheel 30 away from the base plate 20 and to disengage the feed wheel 30 from the upper strap portion 2. FIG. 2 illustrates, more particularly, the release cam 82 engageable with an arm 44 of the link 40 upon rotation of the shaft 80 to move the feed wheel 30 away from the base plate 20. The release cam 82 is phase oriented on the rotatable shaft 80 to move the feed wheel 30 away from the upper strap portion 2 after the sealing member actuator cam moves the sealing member toward the base plate and into engagement with the overlapping strap portions. The exemplary embodiment of FIG. 2 illustrates the relative phase orientations of the release cam 82 and the first die actuator cam 70 on the rotatable shaft 80. The release cam 82 is also phase oriented on the shaft 80 to disengage the feed wheel 30 from the upper strap portion 2 before the strap sealing member is fully disengaged from the overlapping strap portions 2 and 3.

In FIGS. 1 and 3, the sealless strapping tool 10 also comprises an angled strap cutter having a cutting block portion 90 mounted on the base plate 20 and a cutting blade portion 92 actuatable relative to the cutting block portion 90 to sever the end portion 1 of the upper strap portion 2 disposed therebetween on the side of the strap sealing member opposite the feed wheel 30. In the exemplary embodiment, the cutting block portion 90 has an angled cutting edge 91 and the cutting blade portion 92 has a flat edge 93, but in other embodiments an angled cutting edge may be disposed on the cutting blade portion instead of or in addition to the angled edge on the cutting block portion. The angled strap cutter permits cutting non-tensioned, heavier gauge strap, for example steel strap having a width of 1 inch or more.

In the exemplary embodiment of FIGS. 1 and 3, the cutting blade portion 92 is fixedly disposed on, coupled to, or formed unitarily with the third die 64, which is the endmost die in FIG. 1. The strap cutter and more particularly the cutting blade portion 92 thereof is thus actuated to sever the first end portion 1 of the upper strap portion 2 on the side of the strap sealing member opposite the feed wheel 30 when the third die actuator cam 74 moves the third die 64 toward the base plate 20, as illustrated in FIG. 1. Alternatively, the cutting blade portion 92 may be actuated by a separate cam disposed on the shaft 80, or by other means independant of the rotatable shaft 80, as is known generally.

One of the dies is preferably a reversed die that is moved toward the base plate and into engagement with the overlapping strap portions after the joint is formed by the one or more other dies to provide a bi-directionally secured joint. These types of joints are known generally. In the exemplary embodiment, the fourth die 66 is a reversed die moved toward the base plate and into engagement with the overlapping strap portions after disengagement of the first, second and third dies. More particularly, the fourth die actuator cam 76 is phase oriented on the rotatable shaft 80 to move the fourth reversed die 76 toward and into engagement with the overlapping strap portions after the first, second and third dies are disengaged from the overlapping strap portions 2 and 3 by the corresponding first, second and third lifter cams. The fourth lifter cam 77 is phase oriented on the rotatable shaft 80 to thereafter move the fourth die away from the overlapping strap portions 2 and 3, and thus the fourth lifter cam 77 is not necessarily phase oriented commonly with the first, second and third lifter cams.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A sealless strapping tool comprising:

a base plate;

a feed wheel rotatably coupled to a pivotal link, the feed wheel is located adjacent a leading end portion of the base plate;

a strap sealing member;

a lifting cam engageable with the strap sealing member to move the strap sealing member away from the base plate;

a release cam engageable with the link to move the feed wheel away from the base plate, the release cam moves the feed wheel away from the base plate before the lifting cam moves the strap sealing member away from the base plate.

2. The tool of claim 1 further comprising a rotatable cam shaft having the lifting cam and the release cam disposed and phase oriented thereon to move the feed wheel away from the base plate before moving the strap sealing member away from the base plate.

3. The tool of claim 2 further comprising a strap sealing actuator cam disposed on the cam shaft, the strap sealing actuator cam engageable with the strap sealing member to move the strap sealing member toward the base plate.

4. The tool of claim 1 further comprising an angled strap cutter having a cutting block portion mounted on a trailing portion of the base plate and a cutting blade portion, the strap sealing member disposed between the feed wheel and the angled strap cutter.

5. The tool of claim 1, the strap sealing member comprises a punch disposed on the base plate and a first die having a first lifting member, the lifting cam comprises a first die lifting cam engageable with the first lifting member to move the first die away from the punch.

6. The tool of claim 5, the strap sealing member further comprises second and third dies having corresponding second and third lifting members, the lifting cam comprises second and third die lifting cams engageable with the second and third lifting members to move the second and third dies away from the punch.

7. The tool of claim 6 further comprising first, second and third die actuator cams engageable with a corresponding one of the first, second and third dies to sequentially move the first, second and third dies toward the punch.

8. The tool of claim 6 further comprising the first, second and third lifting cams and the release cam are disposed on a common cam shaft.

9. The tool of claim 6, the strap sealing member further comprises a fourth reversed die having a corresponding fourth lifting member, the lifting cam comprises a fourth die lifting cam engageable with the fourth lifting member to move the fourth reversed die away from the punch, a fourth die actuator cam engageable with the fourth reversed die to move the fourth die toward the punch.

10. A method for applying strap with a sealless strapping tool, comprising:

tensioning overlapping strap portions disposed on a base plate with a feed wheel frictionally engaged with an upper strap portion;

sealing the overlapping strap portions with a strap sealing member engageable therewith;

disengaging the feed wheel from the upper strap portion when the strap sealing member is engaged with the overlapping strap portions; and disengaging the strap sealing member from the overlapping strap portions after the feed wheel is disengaged from the upper strap portion.

11. The method of claim 10, the feed wheel is located adjacent a leading end portion of the base plate, further comprising feeding the upper strap portion from the feed wheel toward the base plate.

12. The method of claim 10, the feed wheel is rotatably disposed in a pivotal link, disengaging the feed wheel from the upper strap portion by pivoting the pivotal link with a release cam engageable therewith, and disengaging the strap sealing member from the overlapping strap portions with a lifting cam engageable therewith.

13. The method of claim 10 further comprising partially disengaging the strap sealing member from the overlapping strap portions before disengaging the feed wheel from the upper strap portion, and disengaging the feed wheel from the upper strap portion when the strap sealing member is partially engaged with the overlapping strap portions.

14. The method of claim 10, the strap sealing member comprises a first die and a punch disposed on the base plate, sealing the overlapping strap portions with the first die moved toward and engaged with the overlapping strap portions supported by the punch, disengaging the feed wheel from the upper strap portion when the first die is engaged with the overlapping strap portions, and disengaging the first die from the overlapping strap portions after the feed wheel is disengaged from the upper strap portion.

15. The method of claim 14, the strap sealing member further comprises second and third dies, sealing the overlapping strap portions by sequentially moving the first, second and third dies toward and into engagement with the overlapping strap portions supported by the punch, disengaging the feed wheel from the upper strap portion when the first, second and third dies are engaged with the overlapping strap portions, and disengaging the first, second and third dies from the overlapping strap portions after the feed wheel is disengaged from the upper strap portion.

16. The method of claim 15 further comprising severing the upper strap portion with an angled strap cutter when moving one of the first, second and third dies toward the overlapping strap portions.

17. The method of claim 15, the strap sealing member further comprises a fourth die, moving the fourth die toward and into engagement with the overlapping strap portions after the first, second and third dies are disengaged from the overlapping strap portions.

18. The method of claim 15 further comprising disengaging the first, second and third dies from the overlapping strap portions with corresponding first, second and third lifting cams engageable therewith.

19. The method of claim 18 moving the first, second and third dies toward and into engagement with the overlapping strap portions with corresponding first, second and third die actuator cams engageable therewith.

20. The method of claim 18, the feed wheel is rotatably disposed in a pivotal link, disengaging the feed wheel from the upper strap portion by pivoting the pivotal link with a release cam engageable therewith, rotating the release cam and the first, second and third lifting cams with a common cam shaft.

* * * * *